US007412803B2

(12) United States Patent
Lehn

(10) Patent No.: US 7,412,803 B2
(45) Date of Patent: Aug. 19, 2008

(54) ENDPIECE FOR WOOD SIDING

(76) Inventor: Gregory E. Lehn, 1124 Pine Tree La., Libertyville, IL (US) 60048

( * ) Notice: Subject to any disclaimer, the term of this patent is extended or adjusted under 35 U.S.C. 154(b) by 771 days.

(21) Appl. No.: 10/863,687

(22) Filed: Jun. 8, 2004

(65) Prior Publication Data

US 2005/0284052 A1 Dec. 29, 2005

(51) Int. Cl.

| | |
|---|---|
| ***E04B 1/10*** | (2006.01) |
| ***E04C 1/00*** | (2006.01) |
| ***E04D 1/00*** | (2006.01) |
| ***B44F 7/00*** | (2006.01) |
| ***B44F 9/00*** | (2006.01) |

(52) U.S. Cl. ..... 52/233; 52/309.7; 52/313; 52/554

(58) Field of Classification Search ..... 52/233, 52/309.7, 313, 554

See application file for complete search history.

(56) References Cited

U.S. PATENT DOCUMENTS

| | | | | | |
|---|---|---|---|---|---|
| 2,829,404 | A * | 4/1958 | Wilson | 52/233 |
| 5,253,458 | A * | 10/1993 | Christian | 52/233 |
| 5,586,422 | A | 12/1996 | Hoffner | |
| 5,638,649 | A | 6/1997 | Hovland | |
| 5,700,587 | A * | 12/1997 | Shiau et al. | 428/528 |
| 5,735,099 | A | 4/1998 | Anderson | |
| 5,878,542 | A * | 3/1999 | Cornelius | 52/519 |
| 6,122,877 | A * | 9/2000 | Hendrickson et al. | 52/520 |
| 6,199,332 | B1 * | 3/2001 | Ellson | 52/233 |
| 6,389,765 | B1 * | 5/2002 | Hautala | 52/233 |
| 6,786,015 | B2 * | 9/2004 | Wilt | 52/233 |
| 2001/0017020 | A1 * | 8/2001 | Kern | 52/784.11 |
| 2002/0078650 | A1 * | 6/2002 | Bullinger et al. | 52/539 |
| 2003/0024187 | A1 | 2/2003 | Wilt | |
| 2004/0211136 | A1 * | 10/2004 | Stanton | 52/233 |

* cited by examiner

*Primary Examiner*—Brian Glessner
*Assistant Examiner*—Branon C Painter
(74) *Attorney, Agent, or Firm*—Cardinal Law Group; Ronald E. Andermann

(57) ABSTRACT

An endpiece and method for siding a wall to simulate wood log construction are described. A generally cylindrical core (101) of the endpiece (100) has a curved surface (103), and a flat surface (105). A decorative skin (111) attached to the curved surface (103) has a cross-sectional arc that is greater than one hundred and eighty degrees. When an endpiece (100) is installed on a plank (200), a spline (117) that attaches along a lateral edge (109) of the endpiece interlocks with a bottom spline (215) of a plank (200). Also, a first offset (113) of the decorative skin (111) engages an upper lateral edge (207) of the plank (200). An end cap (301) attaches to a surface formed by an endpiece surface (305) and a plank surface (307).

14 Claims, 3 Drawing Sheets

FIG. 3
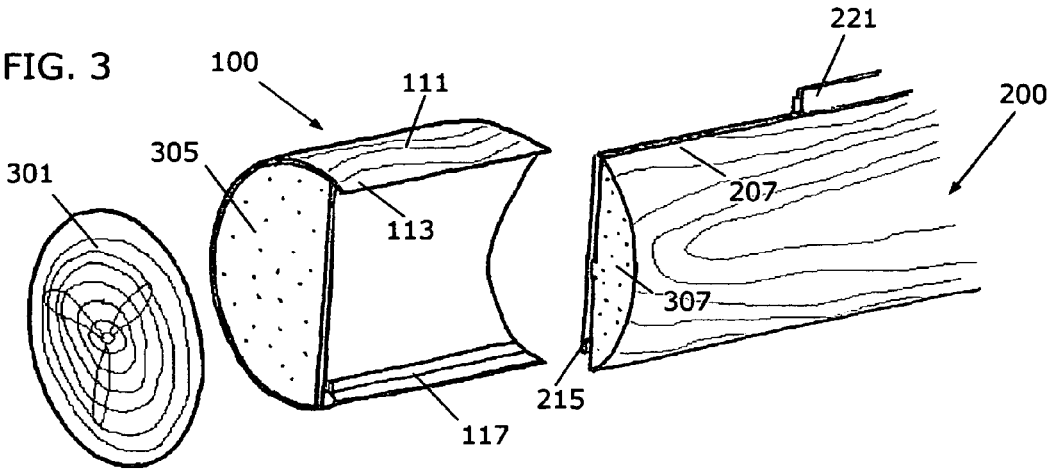
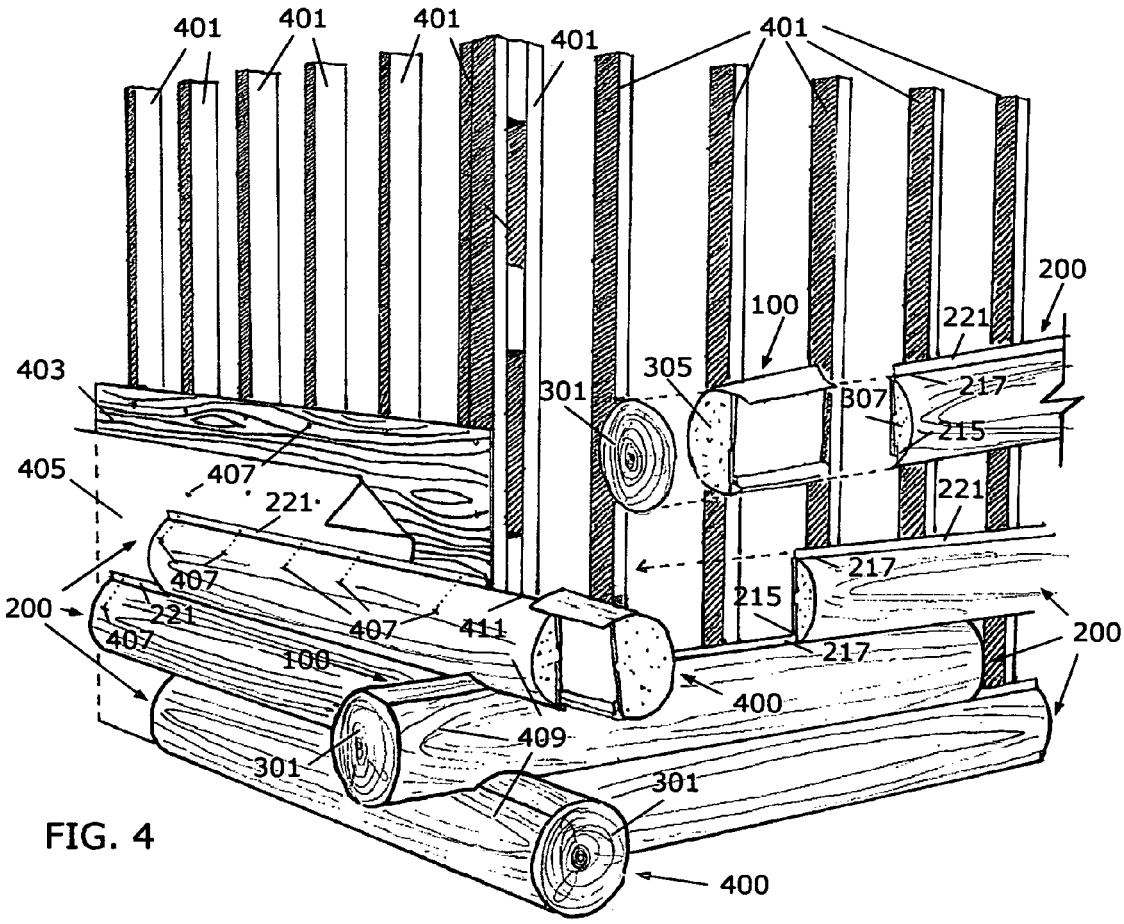
FIG. 4

ENDPIECE FOR WOOD SIDING

CROSS-REFERENCE TO RELATED APPLICATIONS

Not Applicable

STATEMENT REGARDING FEDERALLY SPONSORED RESEARCH/DEVELOPMENT

The present invention does not involve any form of federally sponsored research or development.

BACKGROUND OF THE INVENTION

The present invention relates to simulated wood siding, including, but not limited to, endpieces installed on the ends of simulated wood planks for use in a siding system that simulates wood log construction. Log endpieces and methods for use with wood siding planks, either natural or simulated, are known. Wood siding includes a plurality of planks that are typically attached to studs that form walls, particularly exterior walls. To more accurately simulate wood log construction, special endpieces are used at the edge of a sided wall and at corners. The special endpieces are typically made of natural wood. For example, natural wood endpieces can be attached at the edge of a wall sided with simulated wood planks so as to give the siding the look of wood log construction. At corners, the endpieces typically butt up to the corner, and are appropriately adapted to mesh with siding planks attached to the intersecting walls. The endpieces are typically attached to the underlying wall corner. Whether the siding planks are natural or simulated wood, the endpieces are typically made of natural wood. Because of the weight of natural wood, the endpieces are formed with special tabs or fastener for the mechanical attachment of the endpiece to the wall corner.

The weight of endpieces made of natural wood can require mechanically robust attachment to the underlying wall, and make siding construction laborious. In addition, natural wood endpieces are susceptible to moisture and insects such as termites, and thus wood log endpieces must be either chemically protected, or be periodically replaced. Generally, wood is an expensive material of construction. Finally, endpieces made of actual wood may be considered a less desirable use of natural resources.

Accordingly, there is a need for an endpiece for use in the siding of a wall with simulated wood siding and a method of siding walls where the endpieces are lightweight, easy to install, and insect and rot resistant, yet have the appearance to natural wood.

BRIEF SUMMARY OF THE INVENTION

An endpiece for use with simulated wood siding that includes a generally cylindrical core, and a decorative skin. The decorative skin is attached to and extends beyond lateral edges of an outer curved surface of the cylindrical core such that the decorative skin has a cross-sectional arc greater than one hundred and eighty degrees. In a method of the present invention, the endpiece is attached to an end of a siding plank that extends past an edge of a wall being sided.

BRIEF DESCRIPTION OF THE DRAWINGS

FIG. 3 illustrates the assembly of an end cap, an endpiece, and a plank in accordance with the invention.

FIG. 4 illustrates the use of an endpiece in a simulated wood siding system in accordance with the invention.

DETAILED DESCRIPTION OF THE PREFERRED EMBODIMENT

The present invention includes an endpiece and method for siding a wall that simulates wood log construction. The endpiece includes a generally cylindrical core having a curved surface. A decorative skin that simulates natural wood attaches to the curved surface of the core. Offsets of the decorative skin extend past lateral edges of the curved surface and engage lateral edges of an end of a plank that extends past an edge of a wall. The offsets engage the extensions either directly or through interlocking splines attached to the endpiece and the plank extension.

Figure 1:
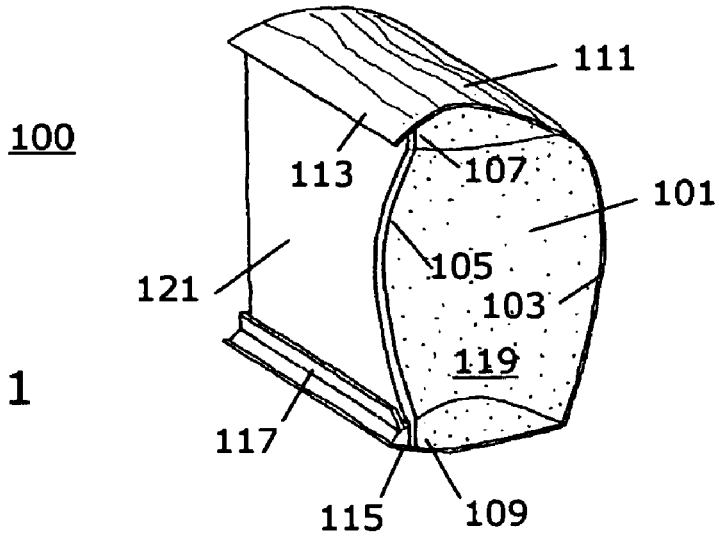
FIG. 1 illustrates an endpiece for use with planks of simulated wall siding in accordance with the invention.

An endpiece for use with planks of simulated wall siding is as shown in FIG. 1. The endpiece 100 has a generally cylindrical core 101. A curved surface 103 of the core 100 intersects a flat surface 105 to form a first lateral edge 107 and a second lateral edge 109. The core is made of rigid foam such as polystyrene that is lightweight. Generally, rigid foams are insect and water resistant and are thermally insulating.

A decorative skin 111, such as hardboard, attaches or is bonded to the curved surface 103. A cross-section of the decorative skin 111 forms an arc that is at least one hundred and eighty degrees. Offsets 113, 115 of the decorative skin extend past the edges 107, 109 of the core 101.

A rigid member 121 attaches to or is bonded to the rigid surface 105. The rigid member 121 can provide a rigid surface for attaching the spline 117. Typically, the rigid member can be formed from wood, plywood, wood composites, and so forth. Alternatively, the rigid member can be eliminated and the spline can be attached or bonded to the flat surface 105 and/or the offset 115. Further, the spline 117 can also be formed as part of the cylindrical core 100, particularly if a molded plastic is used.

The spline 117 runs along the second lateral edge 109. The spline 117 and the offset 113 are used to interlock the endpiece 100 with a siding plank, and a first end 119 of the endpiece is formed to cooperate with an adjacent wall that is typically sided with planks.

Figure 2:
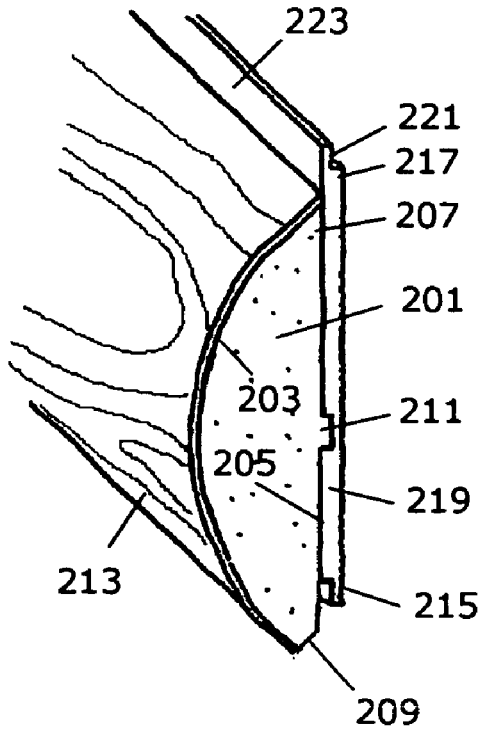
FIG. 2 illustrates a simulated wall siding plank having an end for installing an endpiece in accordance with the invention.

A simulated wall siding plank having an end for installing an endpiece 100 is as shown in FIG. 2. The plank 200 includes a generally cylindrical core 201 having a curved surface 203 and a flat surface 205. Generally, an arc formed by a cross-section of the curved surface 203 is less than one hundred eighty degrees. Lateral edges 207, 209 are formed approximately by the intersection of the curved surface 203 and the flat surface 205. Preferably, a decorative skin 213 attaches to or is bonded to the curved surface 203. Alternatively, the curved surface 203 can be formed so as to have a decorative appearance, thus eliminating the need for the decorative skin. To facilitate the interlocking of adjacent planks during installation of siding and to improve the overall esthetic look of the finished siding, the lateral edges, such as lower lateral edge 209, may be shortened or sculpted by removing a portion of the core and decorative skin as needed.

Lower spline 215 and upper spline 217 are disposed laterally along the corresponding lateral edges 207, 209 so as to form an interlocking tongue and groove system on adjacent planks. The splines can be formed as part of a rigid member 219 that attaches to the flat surface 205. Alternatively, the splines can be formed by other construction techniques. For example, splines can be formed from a plurality of rigid members attached to the flat surface 205 and/or each other. The splines could also be molded in the case the rigid member is made from a molded material such as plastic.

The rigid member 219 can be formed to engage an alignment member 211 that protrudes from and continues laterally down the flat surface 205. The alignment member 219 facilitates plank manufacturing. The rigid member 219 can be made of material such as plywood or other rigid materials. For example, the alignment member could be molded into a rigid member made of plastic and bonded to the cylindrical core.

The upper spline 217 can be formed into a tongue 221 that extends past the decorative skin 213 and has a surface 223. The surface 223 is used to receive nails or other devices for attaching the plank 200 to the wall. The height of the surface 223 can be varied to allow the application of grout to further help simulate wood log construction.

The assembly of an end cap, an endpiece, and a plank is as shown in FIG. 3. To attach the endpiece 100 to the plank 200, a portion of the tongue 221 is trimmed so that endpiece 100 can engage the upper lateral edge 207 of the plank. Alternatively, trimming of the tongue 221 may not be necessary for short tongues such as those designed not to receive any grout. In addition, other spline designs may eliminate the need to trim the tongue. Typically, the desired length of tongue 221 that is removed is determined so that ends of the endpiece 100 and the plank 200 are flush when the endpiece 100 is properly attached to the plank 200.

The endpiece 100 is installed by sliding the endpiece 100 onto the end of a plank 200. Simultaneously, the endpiece spline 117 engages the lower spline 215 of the plank 200. Similarly, the offset 113 engages the lateral edge 207 of the plank 200. When the endpiece 100 has been installed, an end cap 301 attaches to a flat surface that is formed by an endpiece surface 305, and a plank surface 307. Further, when the endpiece 100 is installed, the downward curving shape of the offset 113 promotes water shedding from the siding system.

The endpiece 100 can be attached to the plank 200 with adhesive applied to the contacting edges and surfaces of the endpiece and plank. Typically, the installation is finished by caulking the joints between joined siding members, i.e. endpieces and planks, to form a water-resistant siding system.

The use of an endpiece in a simulated wood siding system is shown in FIG. 4. Typically, endpieces attach at either a right or a left edge of a wall. An endpiece that attaches at the right wall edge is, generally, a mirror image of an endpiece that attaches at a left wall edge. The endpiece 100 in FIG. 1 is an example of an endpiece that attaches at the left wall edge. The endpiece 400 is an example of an endpiece that attaches at the right wall edge. The above description for mounting a left mounted endpiece 100 in FIG. 3 also applies to the right mounted endpiece 400.

The simulated wood siding system includes a plurality of planks 200 that are attached to a wall. The common construction of the wall includes the use of wood studs 401 and plywood 403. The wall construction can also include a vapor barrier 405 and other components.

The splines, the lower spline 215 and the upper spline 217, of adjacent planks 200 interlock. Typically, a plank 200 is secured to the wall, preferably to the studs 401, by nails 407 that are driven through or near the upper spline 217 and into the wall. The next plank 200 is installed by interlocking the lower spline 215 into the upper spline of the plank nailed to the wall. The lower spline 215 of adjacent planks conceals the nails 407 that secure the nailed plank 200 to the wall. Alternatively, the plank can be attached to the wall by other means such as screws, special fasters, adhesive, and so forth.

Only some of the planks 200 at the edge of wall receive endpieces 100, 400. Typically, alternating planks at the edge of a common wall do not receive an endpiece and are formed, by sawing or other mean, to complement an adjacent endpiece to which the plank abuts.

For the planks at the wall edge that receive endpieces, the planks 200 are cut to have an extension 409 that is capable of receiving the endpiece 100, 400. As necessary, a portion 411 of the tongue 221 is removed or sculpted. Endpieces attach to the extensions 409. Right mounted endpieces 400 attach to extensions 409 that extend past a right edge of the wall, and left mounted endpieces 100 attach to extensions 409 that extend past a left edge of the wall. Once the planks have been installed so as to receive the endpieces, the endpieces 100, 400 are installed by simply applying adhesive to appropriate contact points and sliding the endpieces onto the extensions 403. For planks 200 having the tongue 221 constructed to receive grout, the grout can be applied once the planking is attached to the wall. The end caps 301 are installed to the surface formed when the endpieces 100, 400 are properly installed on appropriate extensions 409.

Adhesive can be applied to contacting surfaces of the end caps, endpieces and, extensions to secure attachment. Caulking the intersecting edges of the various siding components can create a water-resistant wall siding system. In addition, the materials used to form the siding components, such as a polystyrene core and hardboard decorative skin, make the siding system resistant to attack by insects and moisture.

Figure 5:
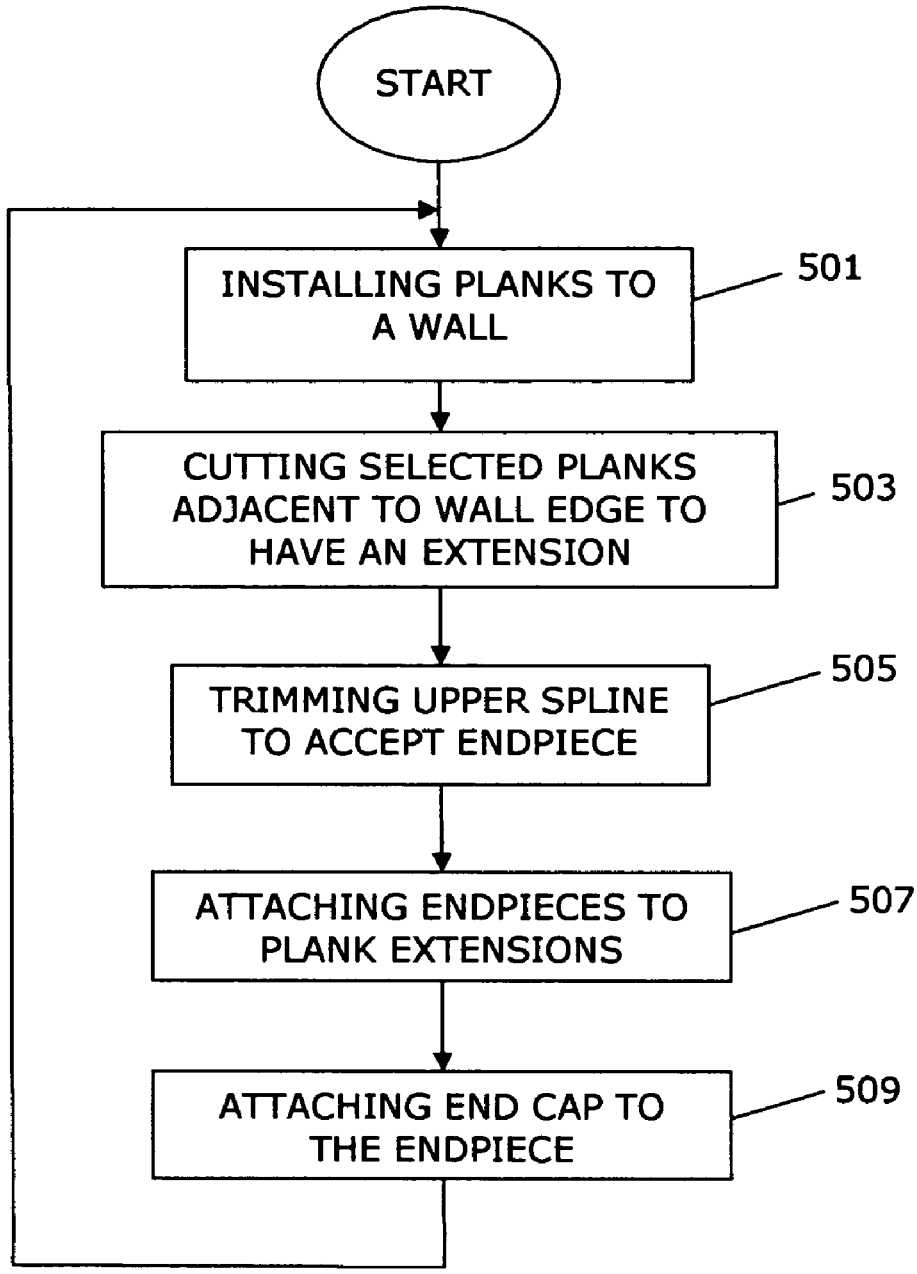
FIG. 5 illustrates a flow diagram for a method of installing an endpiece in a simulated wood siding system in accordance with the invention.

A flow diagram for a method of installing an endpiece in a simulated wood siding system is as shown in FIG. 5. In a method of the present invention, planks 200 are installed on a wall, selected planks adjacent to an edge of the wall are cut to form extensions 409 for receiving endpieces 100, 400, and endpieces 100, 400 are mounted to the extensions 409.

At step 501, a plurality of planks 200 are attached to a wall. Typically, adjacent planks 200 interlock through the engagement of complementary lower and upper splines 215, 217. The planks 200 are secured to the wall by successively nailing planks 200 to the wall such that the nails pass through the plank near the upper spline 217. At step 503, selected planks 200 adjacent to the edge of the wall are cut to have an extension of pre-determined length that extends past the edge so that the extension is capable of accepting the endpiece 100, 400. A portion of the upper spline 217 adjacent to the extension 409 is trimmed, at step 505, to facilitate the installation of the endpiece. At step 507, endpieces 100, 400 are attached to the extensions at the end of the planks 200, and at step 509, end caps 301 are attached to the ends of the joined endpieces 100, 400 and planks 200. Typically, the endpieces and end caps are attached with adhesive and the joints formed between the planks, endpieces, and end caps are caulked to form a water-resistant siding system.

To simulate wood log construction, the endpieces are formed by a number of manufacturing steps. A commercially available rigid polystyrene foam block is machined by a hot wire to yield a plurality of generally cylindrical cores 101 having a curved surface 103 and a flat surface 105. A rigid member 121 is attached to the flat surface 105. A spline 117 that is formed by the machining of a wood board is bonded to the rigid member 121 and is disposed along a first lateral edge 109. The spline 117 is machined to have a side that forms a continuous curved surface with the curved surface 103 of the core. A decorative skin 111 is laminated to the continuous curved surface by a vacuum table diaphragm press having a rubber diaphragm that conforms to the shape of the endpiece. The decorative skin can be hardboard having one side embossed with a hewn log or other esthetic appearance. Alternatively, the decorative skin can be a veneer laminated to plain hardboard without embossing. The veneer, a decorative outer layer, is laminated to the plain hardboard that is laminated to the core. The veneer is laminated to the plain hardboard by a vacuum table diaphragm press that has a rubber diaphragm that conforms to the shape of the endpiece.

The decorative skin 111 is laminated to the core so that the decorative skin extends past a second lateral end 107 of the core to form an offset 113. Alternatively, a spline need not be attached to a first lateral edge of the core, and the decorative skin can be formed to have another offset 115 that extends past a first lateral edge 109 of the core. Once the decorative skin is bonded to the core, an end 119 of the endpiece is machined so that the end 119 complements the siding adjacent to the end 119. The decorative skin can then be painted or stained.

An advantage of the present invention is esthetically pleasing simulated wood siding system constructed from lightweight and insulating planks and endpieces. The light weight of the siding system components simplifies installation saving both time and cost. The planks can be nailed directly to studs without the needs for special support members, channels, or fasteners. The lightweight endpieces can be simply attached to the planks with adhesive and caulk. The siding system is insulating and can eliminate the step of installing a separate layer of insulation. The siding is esthetically pleasing because nails and fasteners used to install the planks are hidden by the interlocking splines. The overlapping nature of the planks and the endpiece forms a water resistant siding system. The materials used to form the siding system component are insect resistant, and can be treated to increase fire resistant. The siding system, except for the possible use of a wood veneer, is made from synthetic materials that minimize the environmental impact on forests.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An endpiece comprising:

a generally cylindrical core having a curved surface and a flat surface, wherein the curved surface and the flat surface meet at a first lateral edge and a second lateral edge;

a decorative skin attached to the curved surface; and at least one engagement portion disposed proximate to the first lateral edge or the second lateral edge, wherein the engagement portion is adapted to engage a lateral section of a siding plank for attachment on a side of the siding plank generally opposite an outer decorative side of the siding plank, so that the outer decorative side of the siding plank and the decorative skin form a generally cylindrical simulated log shape, and wherein a cross-section of the cured surface includes an arc that is generally greater than one hundred eighty degrees.

2. The endpiece of claim 1, wherein the at least one engagement portion is a spline disposed along the first or second lateral edge, wherein the spline is formed to engage a complementary lateral edge of the siding plank.

3. The endpiece of claim 1, further comprising a first end, wherein a surface of the first end cooperates with an outer surface of an adjacent wall.

4. The endpiece of claim 2, further comprising a rigid member attached to the flat surface, wherein the spline is attached to the rigid member.

5. The endpiece of claim 1, wherein the core is formed from rigid foam.

6. The endpiece of claim 1, wherein the decorative skin is a hard board.

7. The endpiece of claim 1, wherein the decorative skin comprises at least two layers.

8. The endpiece of claim 7, wherein an outer layer is wood veneer.

9. The endpiece of claim 1, wherein the at least one engagement portion includes a first offset of the decorative skin that extends past the first lateral edge.

10. The endpiece of claim 1, wherein the at least one engagement portion includes a second offset of the decorative skin that extends past the second lateral edge.

11. The endpiece of claim 1, further comprising a second end surface, wherein the second end surface and a plant end surface form a generally circular continuous surface.

12. The endpiece of claim 11, further comprising an endcap attached to the generally circular continuous surface.

13. The endpiece of claim 12, further comprising an outer decorative surface of the endcap, wherein the outer decorative surface simulates a typical cross-sectional pattern of a natural log.

14. The endpiece of claim 1, wherein the siding plank includes a portion for attaching the siding plank to a structure.

* * * * *